US010743699B2

(12) United States Patent
Ng

(10) Patent No.: US 10,743,699 B2
(45) Date of Patent: Aug. 18, 2020

(54) ADJUSTMENT AND ALIGNMENT SYSTEM FOR A ROLLER BLIND

(71) Applicant: ZMC Metal Coating Inc., Woodbridge (CA)

(72) Inventor: Philip Ng, Thornhill (CA)

(73) Assignee: ZMC Metal Coating Inc., Woodbridge, Ontario (CA)

( * ) Notice: Subject to any disclaimer, the term of this patent is extended or adjusted under 35 U.S.C. 154(b) by 0 days.

(21) Appl. No.: 16/562,665

(22) Filed: Sep. 6, 2019

(65) Prior Publication Data

US 2020/0077828 A1 Mar. 12, 2020

Related U.S. Application Data

(62) Division of application No. 16/045,830, filed on Jul. 26, 2018, now Pat. No. 10,588,442.

(60) Provisional application No. 62/616,004, filed on Jan. 11, 2018, provisional application No. 62/539,022, filed on Jul. 31, 2017.

(51) Int. Cl.

| | |
|---|---|
| ***A47H 1/13*** | (2006.01) |
| ***E06B 9/44*** | (2006.01) |
| ***E06B 9/50*** | (2006.01) |
| *E06B 9/40* | (2006.01) |

(52) U.S. Cl.

CPC ..... *A47H 1/13* (2013.01); *E06B 9/44* (2013.01); *E06B 9/50* (2013.01); *E06B 2009/402* (2013.01); *E06B 2009/405* (2013.01)

(58) Field of Classification Search

CPC .... A47H 1/13; E06B 9/50; E06B 9/44; E06B 2009/405; E06B 2009/402

USPC ..... 248/252, 253, 254, 256, 257, 260, 262, 248/265, 266

See application file for complete search history.

(56) References Cited

U.S. PATENT DOCUMENTS

| | | | | |
|---|---|---|---|---|
| 8,122,932 | B2 * | 2/2012 | Cannaverde | E06B 9/174 160/120 |
| 9,279,286 | B2 * | 3/2016 | Higgins | E06B 9/174 |
| 2005/0087313 | A1 * | 4/2005 | Nichols, Jr. | E06B 9/174 160/310 |
| 2006/0272782 | A1 * | 12/2006 | Nichols, Jr. | E06B 9/44 160/120 |
| 2008/0135191 | A1 * | 6/2008 | Zakowski | E06B 9/50 160/181 |
| 2008/0153606 | A1 * | 6/2008 | Koop | F16D 7/044 464/83 |

(Continued)

*Primary Examiner* — Muhammad Ijaz

(74) *Attorney, Agent, or Firm* — Laurence P. Colton; Smith Tempel Blaha LLC

(57) ABSTRACT

An alignment bracket for a roller blind, comprising a base and a roller tube support securable to the base. First and second coupling members on the base and roller tube support permit an adjustment of the alignment of the roller tube support, and the end of a roller tube mounted thereon, relative to the base. Also provided is a blind fabric alignment device for a roller tube of a multi-tube roller blind. The alignment device comprises a drive coupling body securable to an end of a roller tube of the blind, a driven member mounted to the drive coupling body, a torque transfer mechanism secured to the driven member, and an adjuster. The torque transfer mechanism transfers rotational torque from the driven member to the drive coupling body through the adjuster. The adjuster permits an alteration of the rotational position of the driven member relative to the drive coupling body.

8 Claims, 20 Drawing Sheets

(56) References Cited

U.S. PATENT DOCUMENTS

| | | | | |
|---|---|---|---|---|
| 2009/0090474 | A1* | 4/2009 | Rasmussen | E06B 9/50 160/310 |
| 2010/0252211 | A1* | 10/2010 | Barnes | E06B 9/50 160/120 |
| 2011/0024064 | A1* | 2/2011 | Ng | E06B 9/42 160/317 |
| 2012/0177438 | A1* | 7/2012 | Ng | E06B 9/42 403/293 |
| 2013/0133841 | A1* | 5/2013 | Barnes | E06B 9/50 160/120 |
| 2016/0053537 | A1* | 2/2016 | Dybdahl | E06B 9/50 160/310 |
| 2017/0095103 | A1* | 4/2017 | Pham | A47H 5/0325 |
| 2019/0316414 | A1* | 10/2019 | Zhang | E06B 9/50 |

* cited by examiner 4
40
2
5
39
38
37
28
"B"

ADJUSTMENT AND ALIGNMENT SYSTEM FOR A ROLLER BLIND

CROSS-REFERENCE TO RELATED APPLICATIONS

This application is a divisional of U.S. patent application Ser. No. 16/045,830 having a filing date of 26 Jul. 2018, which claims priority on and the benefit of U.S. Provisional Patent Application No. 62/539,022 having a filing date of 31 Jul. 2017, and U.S. Provisional Patent Application No. 62/616,004 having a filing date of 11 Jan. 2018.

BACKGROUND OF THE INVENTION

Technical Field

This invention relates to the field of roller blinds, including systems and devices for their adjustment and alignment.

Prior Art

Roller blinds, or roller shades as they are sometimes referred to, are commonly placed about windows and other openings for the purpose of privacy, to limit light intrusion, and for aesthetic reasons. Roller blinds have more recently become commonly used in association with large and multiple pane windows, such that in many instances multiple roller tubes are mounted end-to-end, with their blind fabrics being raised or lowered in unison by a drive mechanism at one end of the blind. In commercial applications, and to some extent in residential situations, electric motors are used to raise and lower the blind fabric. When multiple roller tubes are mounted end-to-end, installation can become increasingly difficult and laborious. Typically, an end bracket is positioned at the extreme left and right ends of the multiple tube blind to hold the outer ends in place within a window frame or other structure. Middle brackets are then commonly deployed between the end brackets at the point of juncture between adjacent roller tubes.

It will be appreciated that a misalignment of the end brackets and the middle bracket can cause difficulty in terms of both installing the roller tubes in an end-to-end fashion and also in operation of the tubes. Blinds having three or more individual roller tubes, necessitating the use of two or more middle brackets, can further enhance installation difficulties, causing installers at times having to resort to removing middle brackets and repositioning them. In other instances, installers must loosen fasteners that hold the middle brackets in place, re-position the middle brackets to account for the lack of alignment (or longitudinal positioning relative to the end brackets), and then once again tighten the fasteners to secure the middle brackets.

Further, for multi-roller tube blinds it will be appreciated that slight differences in the relative position blind fabric on adjacent roller tubes can result in the bottom bars of each individual blind segment being misaligned, causing a less than desirous visual appearance. In such cases installers are typically required to remove an individual blind segment and adjust the winding of the blind fabric about that individual roller tube in an attempt to rectify the misalignment problem.

BRIEF SUMMARY OF THE INVENTION

In one aspect the invention provides an alignment bracket for a roller blind, the alignment bracket comprising a base portion having a mounting face, for mounting to a surface upon which the roller blind is to be secured, and an opposed roller tube support surface, and a roller tube support releasably securable to said roller tube support surface, one of said tube support surface and said roller tube support having a first coupling member that is releasably securable to a second coupling member on the other of said tube support surface and said roller tube support to releasably secure said roller tube support to the roller tube support surface, said first and said second coupling members permitting an adjustment of the alignment of said roller tube support, and the end of a roller tube mounted thereon, relative to the base portion.

In another aspect the invention provides an alignment bracket for a roller blind that includes a pair of roller tubes mounted in an end to end configuration, the alignment bracket comprising a base having a mounting surface, for mounting to a surface upon which the roller blind is to be secured, and an opposed roller tube support surface, said roller tube support surface including a slot thereon; and a roller tube support including a tongue that is releasably receivable within said slot of said roller tube support surface to releasably secure said roller tube support to said roller tube support surface, said roller tube support including one or more mounts to support the two roller tubes in the end-to-end configuration, the receipt of said tongue within said slot permitting an adjustment of the roller tube support relative to the base to accommodate the support of the roller tubes in the end to end configuration.

There is also provided a blind fabric alignment device for a roller tube of a multi-tube roller blind, the alignment device comprising a drive coupling body securable to an end of a roller tube of the roller blind, when secured to the roller tube rotation of said drive coupling body causing a corresponding rotation of the roller tube; a driven member mounted to said drive coupling body, said driven member securable to a source of transfer rotational torque; a torque transfer mechanism secured to said driven member such that rotation of said driven member causes rotational torque to be transferred to said drive coupling body through said torque transfer mechanism; and an adjuster positioned on said drive coupling body, said torque transfer mechanism transferring rotational torque from said driven member to said drive coupling body through said adjuster, said adjuster permitting an alteration of the rotational position of said driven member relative to said drive coupling body.

In yet a further aspect the invention concerns a blind fabric alignment device for a roller tube of a multi-tube roller blind, the alignment device comprising a drive coupling body securable to an end of a roller tube of the roller blind, when secured to the roller tube rotation of said drive coupling body causing a corresponding rotation of the roller tube; a pin rotationally received within said drive coupling body and having an end securable to a source of rotational torque, said pin having a longitudinal axis generally aligned with the longitudinal axis of said drive coupling body, said pin including a radially oriented flange; and a pair of opposed posts threadably secured to said drive coupling body, wherein rotational torque applied to said pin in a first direction causes the engagement of said flange with one of said opposed posts causing said drive coupling body to rotate in a first direction, and wherein rotation of said pin in an opposite direction causes said flange to bear against the opposite of said posts causing said drive coupling body to rotate in said opposite direction, whereby altering the position of said posts relative to said drive coupling body alters the rotational point of contact between said flange and said posts and the relative rotational position of said pin with respect to said drive coupling body and a roller tube secured thereto.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DETAILED DESCRIPTION OF PREFERRED EMBODIMENTS

Figure 1:
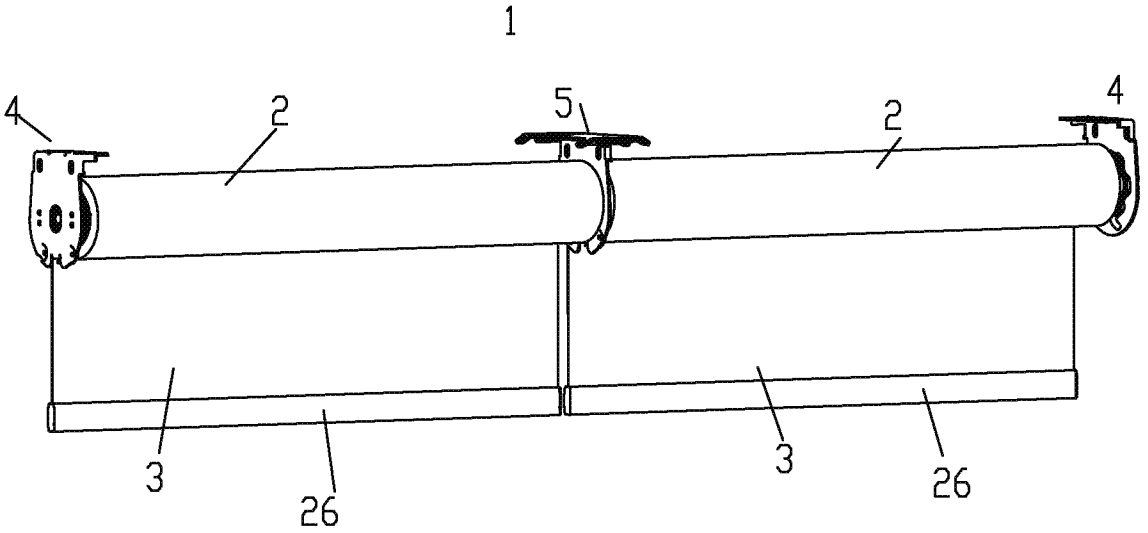
FIG. 1 is an upper side perspective view of a roller blind comprised of two individual roller tubes mounted end-to-end.
Figure 2:
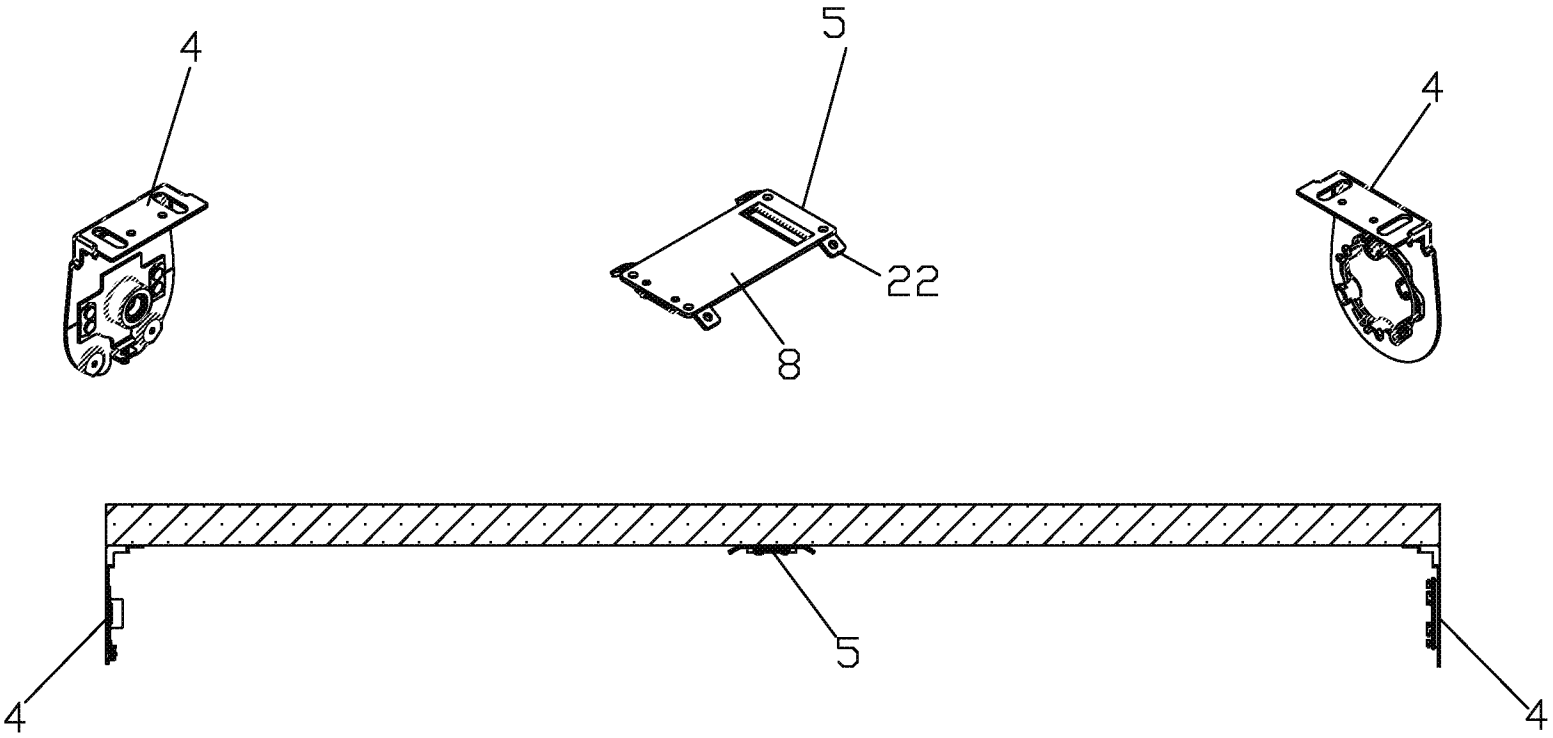
FIG. 2 is a partial exploded view of a dual tube roller blind assembly in accordance with an embodiment of the invention wherein, for illustrative purposes, the roller tubes have been removed, showing the blind end brackets and the base portion of the blind's middle bracket.

The present invention may be embodied in a number of different forms. The specification and drawings that follow describe and disclose some of the specific forms of the invention.

With reference to the attached drawings, there is shown a roller blind 1 that is comprised generally of a roller tube 2 having wound thereon blind fabric 3. The roller tube 2 is attached to a window frame or other structure through use of a pair of end brackets 4. Where roller blind 1 is a multi-tube, multi-roller or multi-shade blind (containing two or more roller tubes mounted end-to-end), one or more middle brackets 5 will be positioned between the respective ends of two adjacent roller tubes.

With specific reference to FIGS. 2 through 10*b*, there is depicted a middle bracket 5 that comprises an alignment bracket. Middle or alignment bracket 5 may be formed from a base portion 6 and a roller tube support 7. Base portion 6 has an upper mounting face 8 that will be secured to the window frame or other structure about which the blind is to be fastened, typically through the use of screws passing from an opposed lower tube support surface 9 through holes 10 in base portion 6. In one preferred embodiment of the invention, roller tube support 7 is releasably securable to lower tube support surface 9. Further, one of tube support surface 9 and roller tube support 7 will have or be fitted with a first coupling member 11 that is releasably securable to a second coupling member 12 on the other of the tube support surface and the roller tube support. The engagement or interaction between the first and second coupling members releasably secures roller tube support 7 to lower tube support surface 9.

In the particular embodiment of the invention shown in the attached FIGS., first coupling member 11 comprises a slot 13 on lower support surface 9. In the same embodiment, second coupling member 12 comprises a tongue 14 upon roller tube support 7. Here, tongue 14 is generally at right angles to support arm 15 of roller tube support 7. Support arm 15 may include a bearing and/or bushing 16 (or other similar structures commonly found on roller tube brackets) for purposes of mounting the end of a roller tube. In application, tongue 14 will be sized and configured so as to be releasably receivable within slot 13. Middle or adjustment bracket 5 may further include a lock to fix the relative positions of tongue 14 and slot 13 when the tongue is received within the slot. It will be appreciated that a variety of different locks and locking mechanisms could be utilized. In the embodiment of the attached drawings, the lock comprises a screw 17 received within tongue 14 and bearing against lower tube support surface 9 of base portion 6 to cause a frictional engagement therebetween.

It will thus be appreciated that when tongue 14 is received within slot 13 and base portion 6 is secured to the window frame or other structure about which roller blind 1 is to be mounted, support arm 15 will provide a means to support the adjacent ends of two roller tubes that are mounted longitudinally in an end-to-end configuration. It will further be appreciated by one skilled in the art that in embodiments other than that specifically shown in the attached drawings, alternate forms of first and second coupling members could be utilized. In a further alternate embodiment of the invention, tongue 14 could be incorporated into lower tube support surface 9 of base portion 6, with slot 13 incorporated into roller tube support 7.

Through the releasable securing of roller tube support 7 to base portion 6, the longitudinal position of support arm 15 relative to each of the end brackets 4 can be adjusted in order to safely and effectively secure the two ends of the adjacent roller tubes, particularly in instances where base portion 6 may not have been screwed to the window frame (or other structure about which lower blind 1 has been mounted) in precisely the correct location. That is, the interaction between the respective first and second coupling members permits a degree of longitudinal movement or adjustment of support arm 15 to accommodate slight discrepancies in the mounting position of base portion 6. Further, in an embodiment of the invention one of slot 13 and tongue 14 includes at least one convex surface that engages a surface of the other of the slot and tongue when the tongue is received within slot 13. In the attached drawings, the opposed outer ends 18 of tongue 14 are convex. As shown most particularly in FIGS. 5 and 6, in instances where base portion 6 has not been secured to the window frame (or the surface about which lower blind 1 is to be mounted) at a location that it permits a longitudinal alignment of adjacent roller tubes, the engagement of one or both of convex ends 18 of tongue 14 with the interior edges 19 of slot 13 permits an "adjustment" of the alignment of roller tube support 7, and the ends of roller tubes mounted hereon, relative to base portion 6. That is, the convex nature of the ends 18 of tongue 14 will permit a degree of "twisting" of roller tube support 7 relative to base portion 6 that can be beneficial in helping to align the ends of the roller tubes. In other instances, it may be desirable to construct the overall "length" of tongue 14 such that it is smaller in dimension than the "length" of slot 13 to permit a degree of "play" between the tongue and slot to further assist in the alignment of adjacent roller tubes. Once the roller tubes have been sufficiently aligned, lock 17 can be engaged to fix the relative position of roller tube support 7 with respect to base portion 6.

Figure 3:
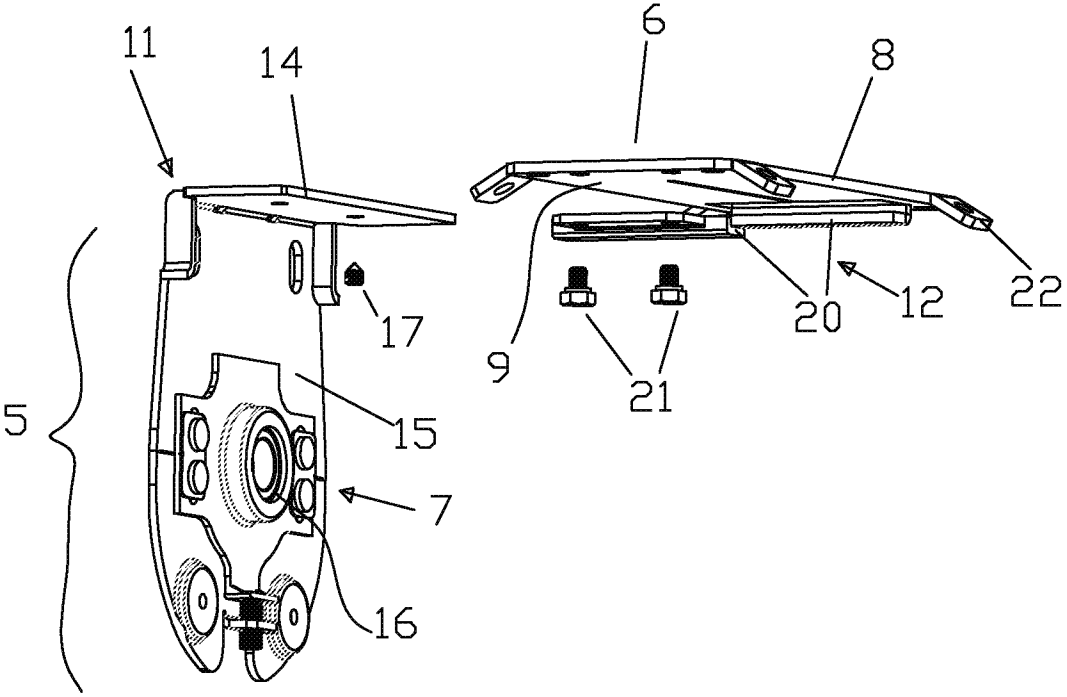
FIG. 3 is a lower perspective exploded view of an alignment bracket constructed in accordance with an embodiment of the invention.
Figure 4C:
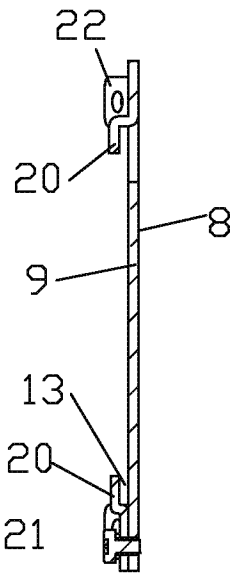
FIG. 4*c* is a sectional view taken along the line A-A of FIG. 4*b;*
Figure 4B:
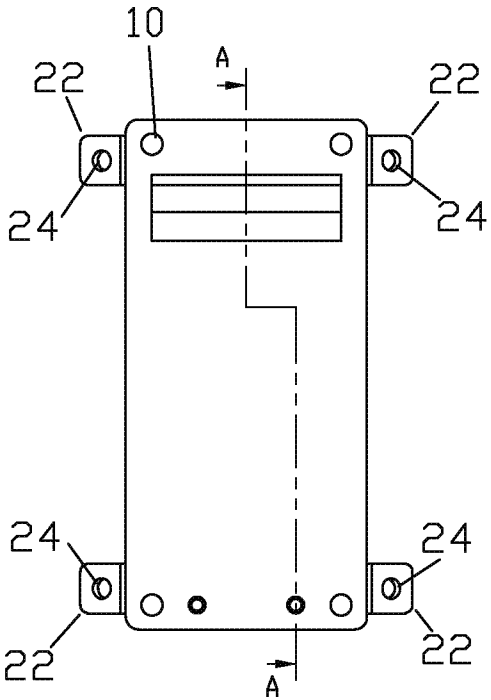
FIG. 4*b* is a plan view of the base portion of the alignment bracket shown in FIG. 3.
Figure 4A:
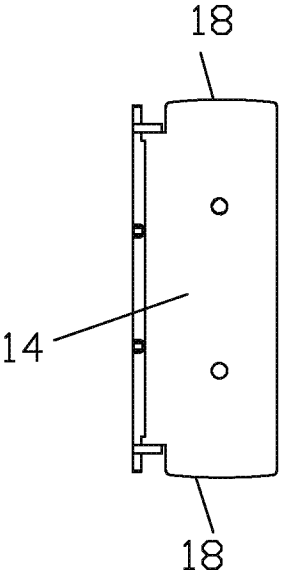
FIG. 4*a* is a plan view of the roller tube support of the alignment bracket shown in FIG. 3.
Figure 5:
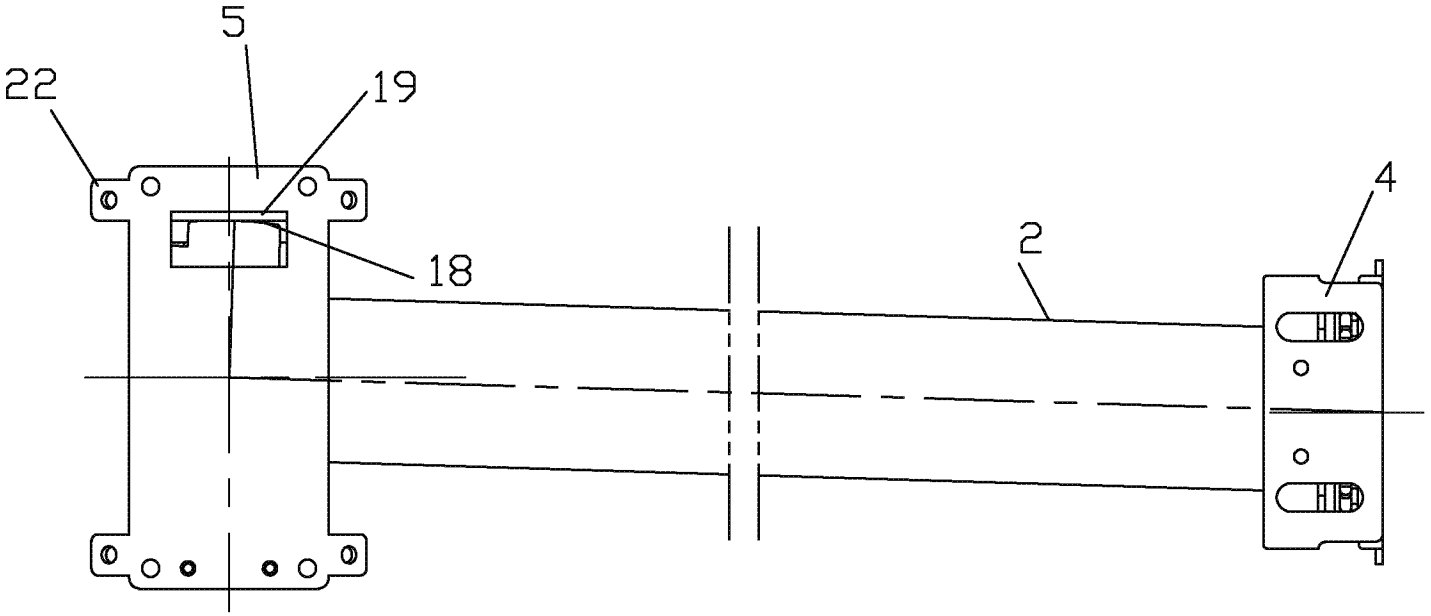
FIG. 5 is a partial plan view of a roller blind demonstrating the relative engagement of the blind tube with an end bracket and the alignment bracket of FIG. 3 wherein the roller tube is misaligned.
Figure 6:
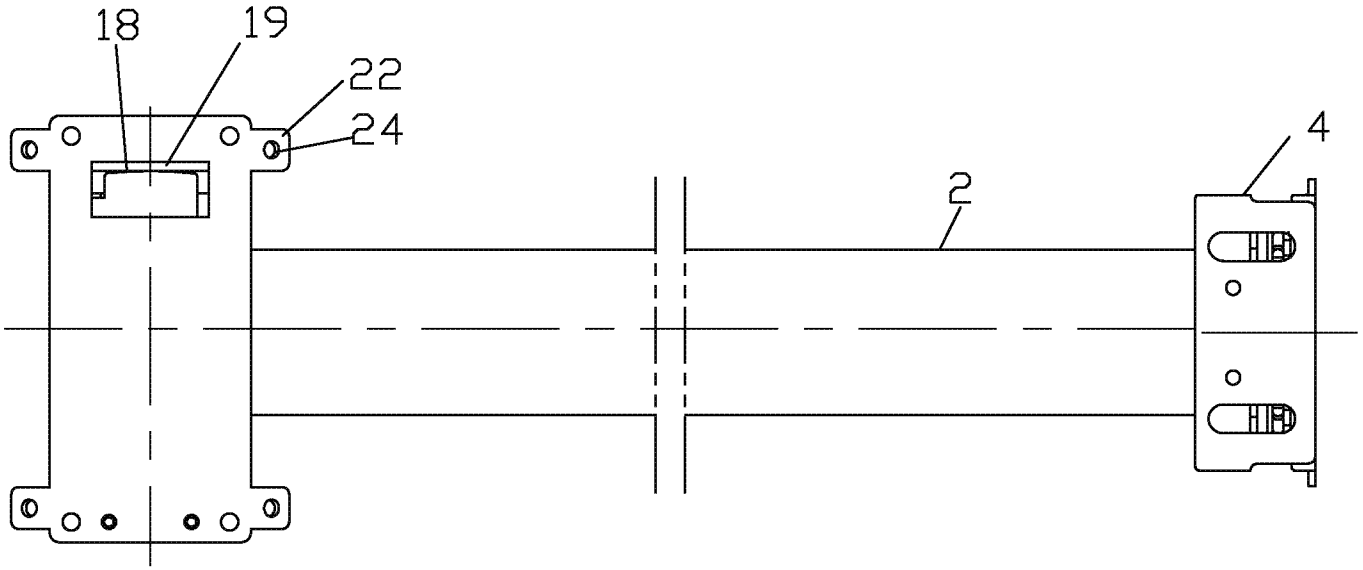
FIG. 6 is a view similar to FIG. 5 wherein the roller tube has been aligned through operation of the alignment bracket.

With particular reference to FIGS. 3, 4*b* and 4*c*, in one embodiment of the invention, slot 13 is formed from two spaced apart flanges 20, where at least one of the flanges is releasably securable to base portion 6. One of the flanges 20 is constructed from a separate component that is secured to base portion 6 by way of screws or bolts 21. Further, as noted in FIGS. 3 and 4*b*, base portion 6 may be fitted with one or more suspension tabs 22 for receiving one or more roller tube suspension hooks 23 (see FIGS. 7 and 8). In this particular embodiment, suspension tabs 22 contain holes 24 through which the ends of a generally semi-circular or U-shaped roller tube suspension hook can be received and supported.

Figure 7:
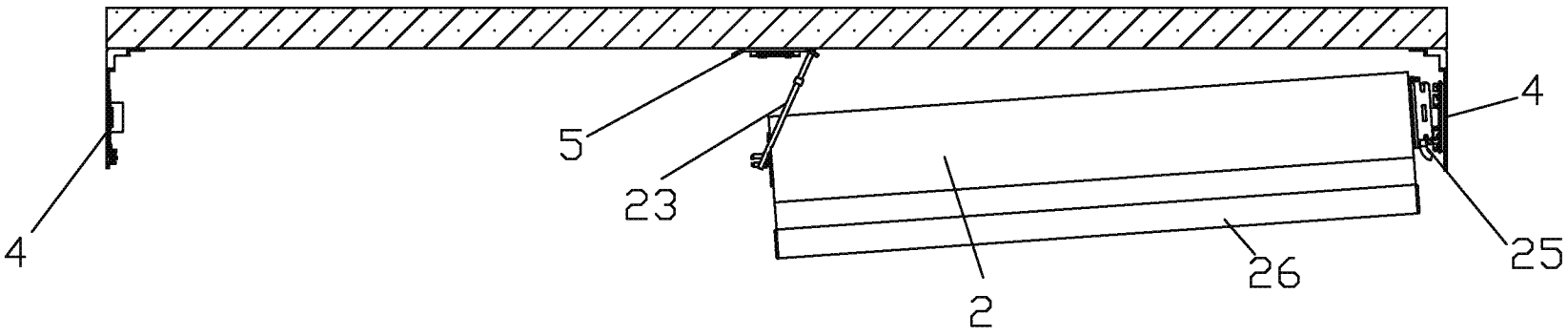
FIG. 7 is a partial side view demonstrating a method of installation of the roller blind using the alignment bracket of FIG. 3.
Figure 8:
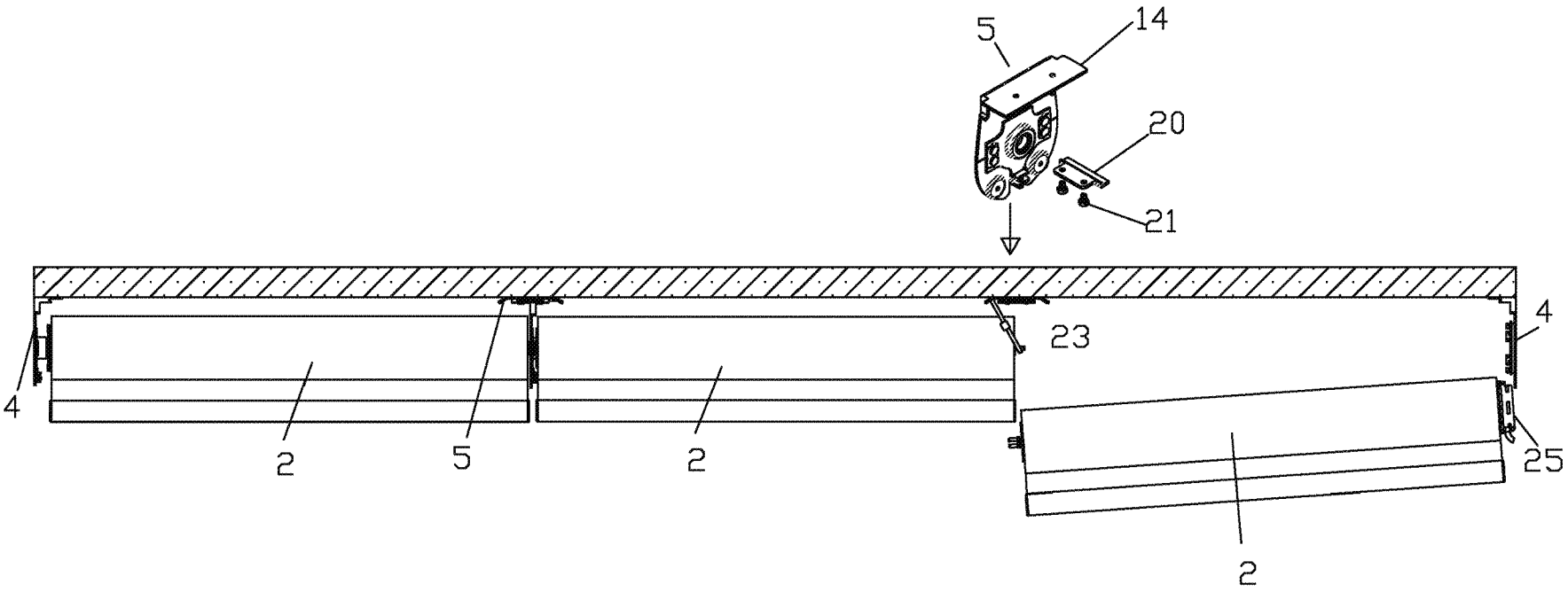
FIG. 8 is a view similar to FIG. 7 demonstrating how through use of the alignment bracket of FIG. 3 a single roller tube of a multi-tube roller blind can be removed for servicing.

The combination of one or more removable flanges 20 forming slot 13, in conjunction with suspension tabs 20, facilitates both the installation of the roller blind and also its disassembly for servicing. With particular reference to FIGS. 7 and 8, installation of a multi-tube blind merely requires that one end of a roller tube be secured to or received by an end bracket, with the opposite end of the roller tube engaged and held in place by a roller tube suspension hook secured to suspension tabs 22. The installer is then able to install the adjacent roller tube by inserting one end into a fixed end bracket and then simultaneously secure the ends of the two adjacent tubes within support arm 15 of roller tube support 7. Thereafter one end of tongue 14 can be inserted into a fixed flange 20 (or a removable flange that has been previously fixed in place) on base portion 6, while the other end of tongue 14 is held against the lower tube support surface 9 until removable flange 20 can be bolted, screwed or otherwise fastened to base portion 6.

It will be understood that disassembly of a full installed multi-tube roller blind will also be facilitated by the above described structure. In order to disassemble an installed blind, one must merely remove screws or bolts 21 from removable flange 20, permitting tongue 14 to be slid from slot 13 to allow the adjacent ends of two end-to-end mounted roller tubes to be lowered. A roller tube suspension hook 23, previously secured to suspension tabs 22 of base portion 6, can then hold the end of one of the roller tubes while the other roller tube is removed from the blind assembly.

Middle or adjustment bracket 5 presents not only the ability to support adjacent ends of end-to-end mounted roller tubes, but it also provides a means by which to "adjust" the ends of the roller tubes to facilitate their alignment in situations where the middle bracket has not been mounted to a window frame or other structure in the precise location that enables a desired degree of alignment of the roller tubes. The structure of base portion 6 and roller tube support 7 further facilitate both the installation and disassembly of a multi-tube roller blind by a single individual.

Figure 9B:
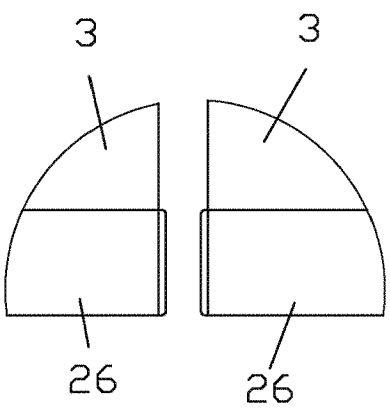
FIG. 9*b* is a detail view of portion "E" of FIG. 9*a;*
Figure 9A:
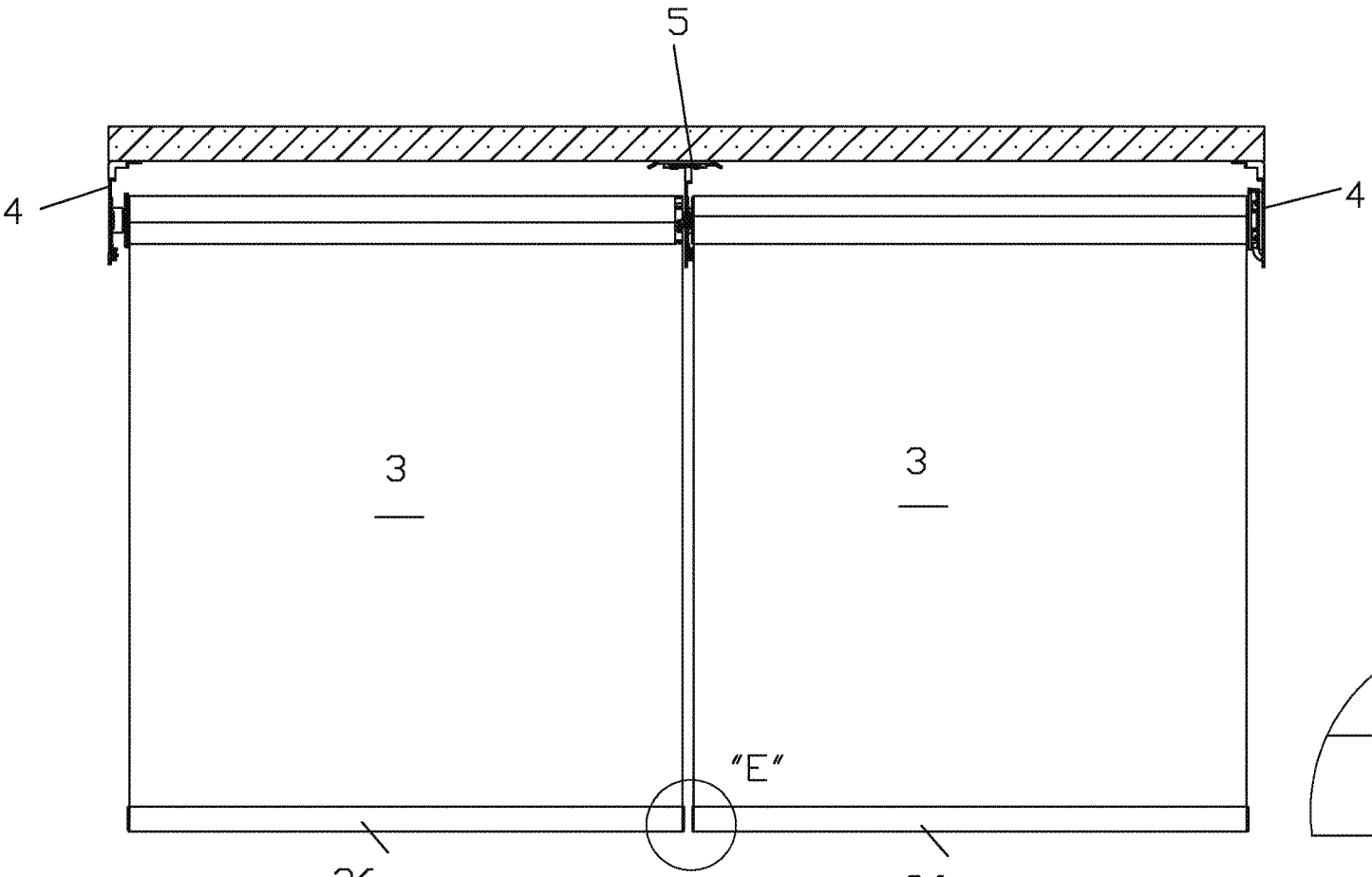
FIG. 9*a* is a side view of a dual shade roller blind demonstrating an alignment of the bottom bars of the two blind fabrics.
Figure 10B:
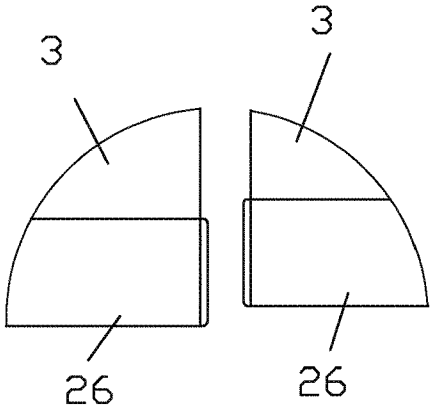
FIG. 10*b* is a detail view of portion "D" of FIG. 10.
Figure 10A:
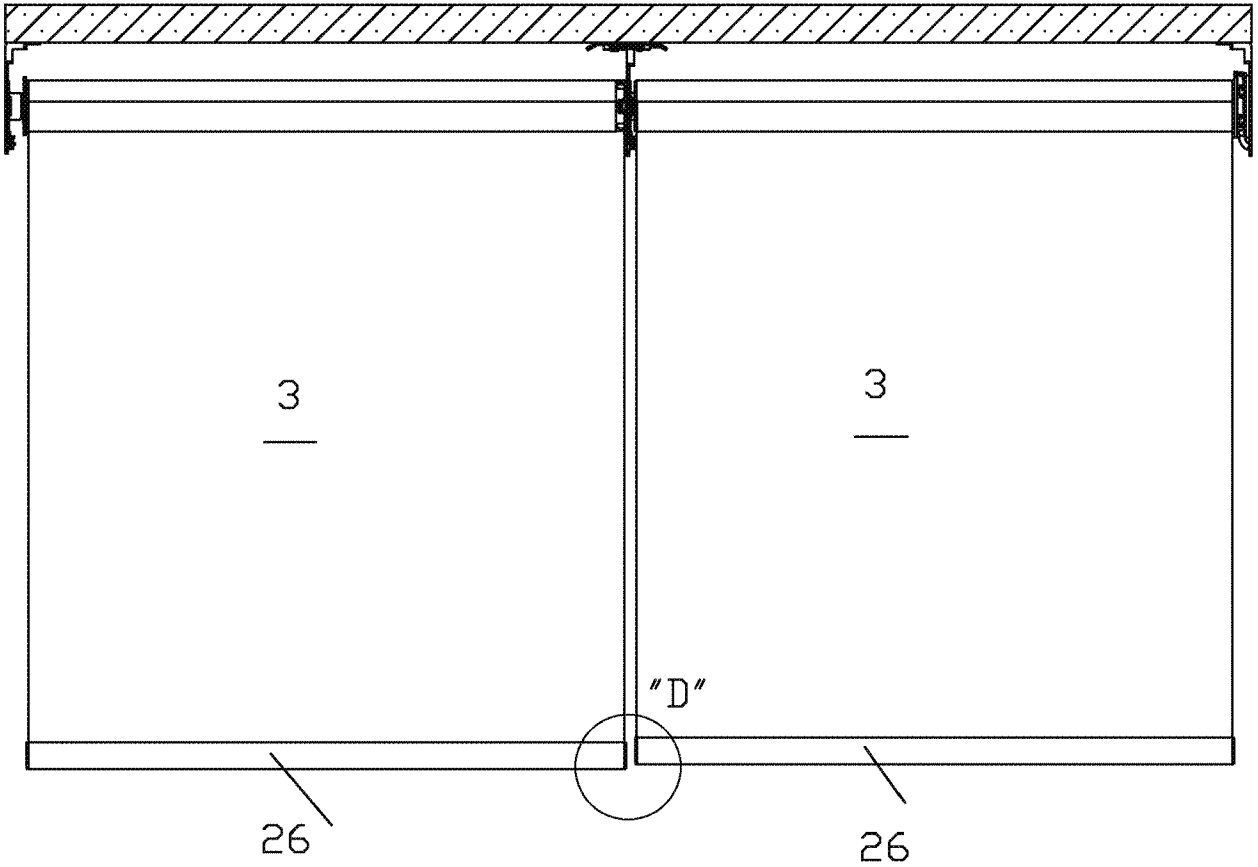
FIG. 10*a* is a view similar to FIG. 9 showing a misalignment of the bottom bars of the two bland fabrics.
Figures 11A, 11B, 11C:
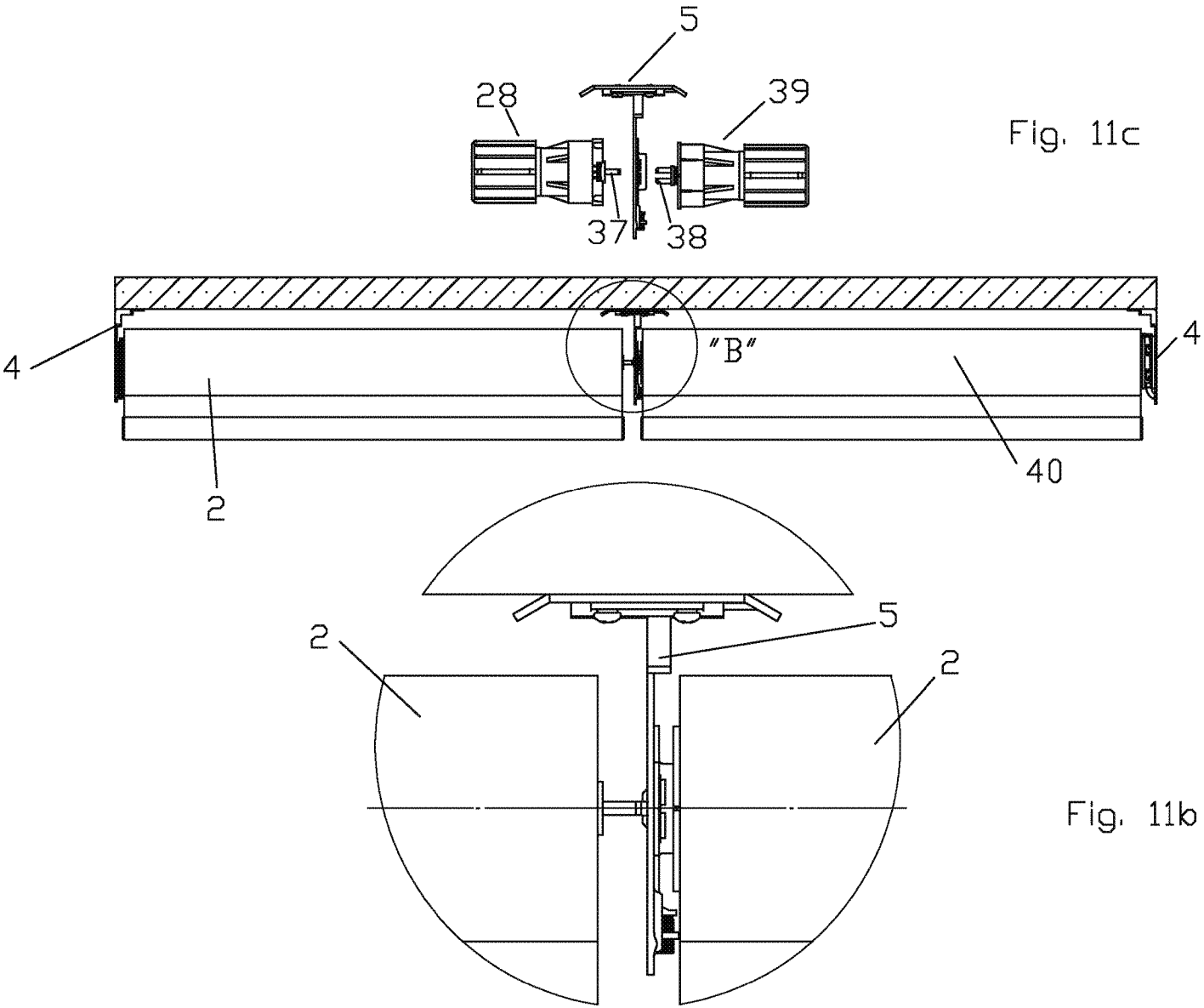
FIG. 11*a* is a side view of the roller blind shown in FIG. 9 wherein the blind fabrics are wound upon their respective roller tubes.
FIG. 11*b* is an enlarged detailed view of portion "B" of FIG. 11*a;*
FIG. 11*c* is a partial exploded view of FIG. 11*b* having the roller tubes removed.
Figure 12:
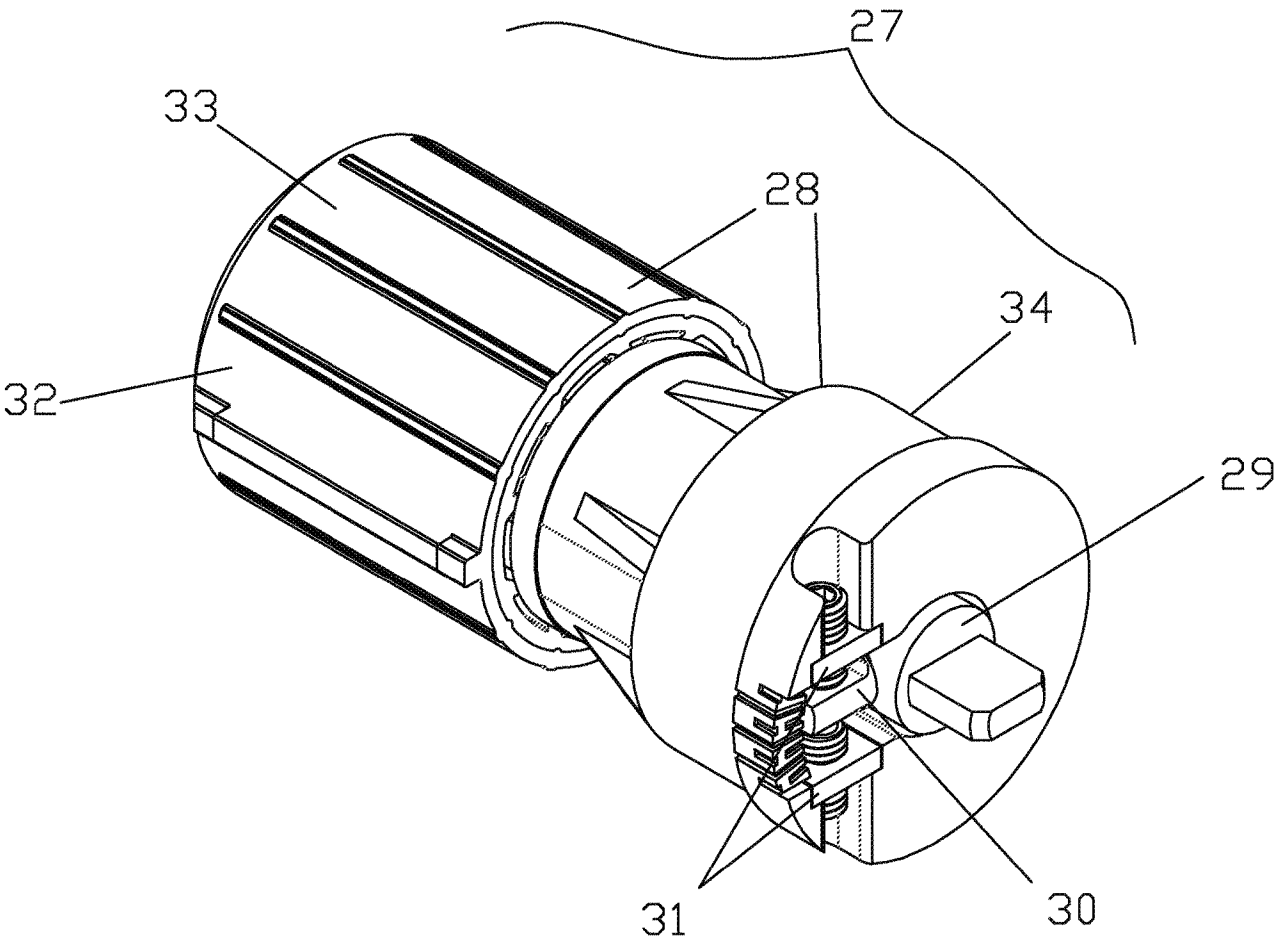
FIG. 12 is an upper end perspective view of the roller blind drive coupling of the left roller tube of FIG. 11*a;*
Figure 13:
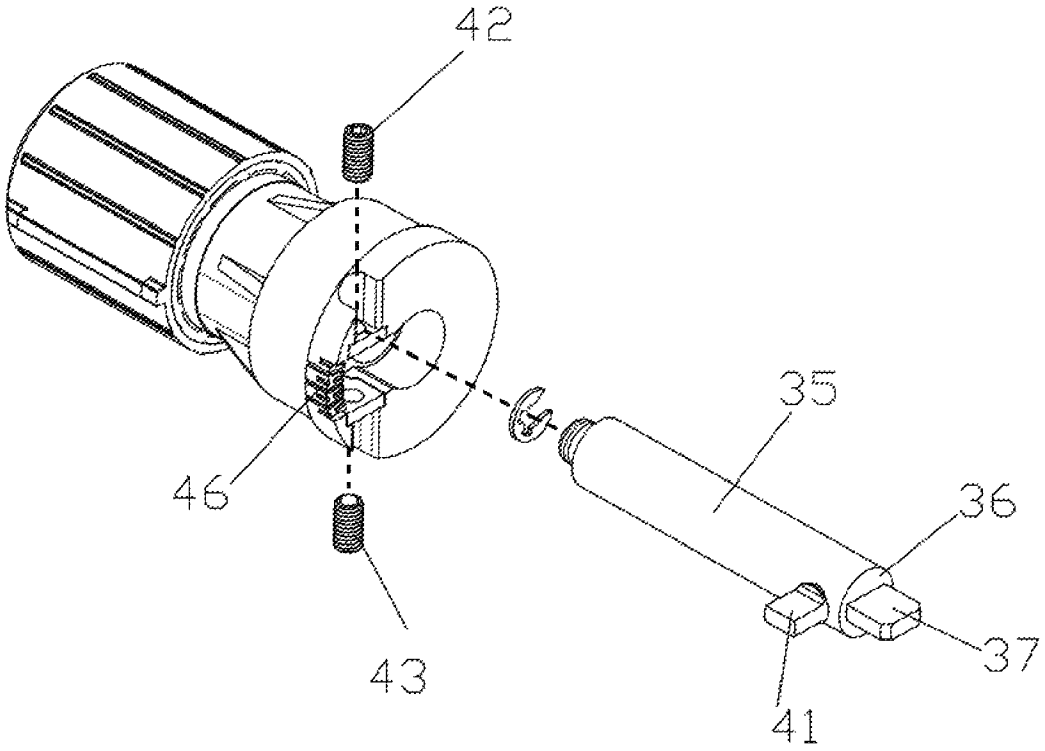
FIG. 13 is a partial exploded view of the drive coupling shown in FIG. 12.
Figure 14B:
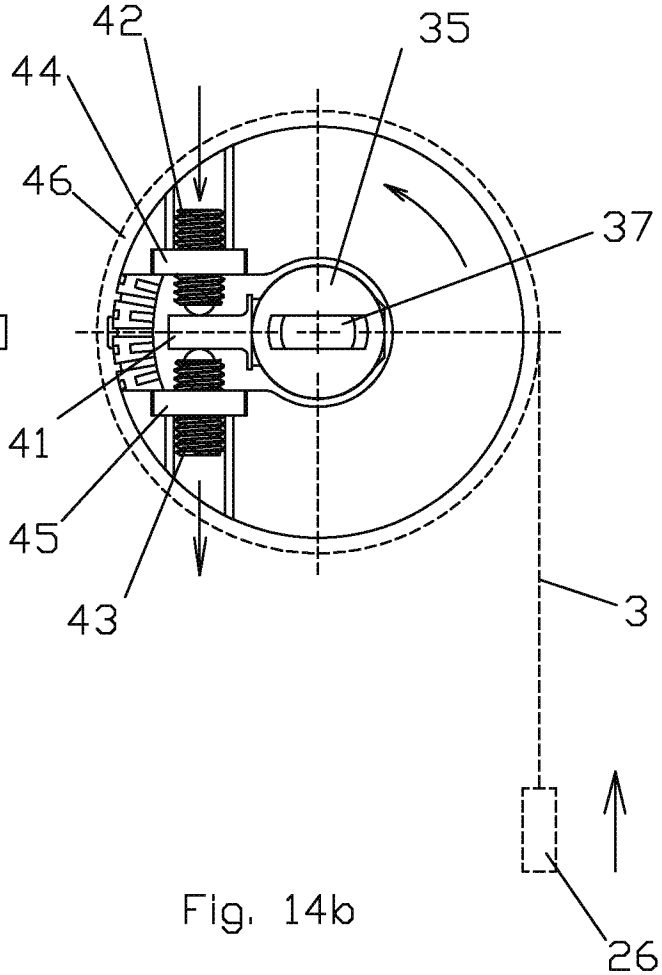
FIG. 14*b* is a right end view of the drive coupling shown in FIG. 14*a;*
Figure 14A:
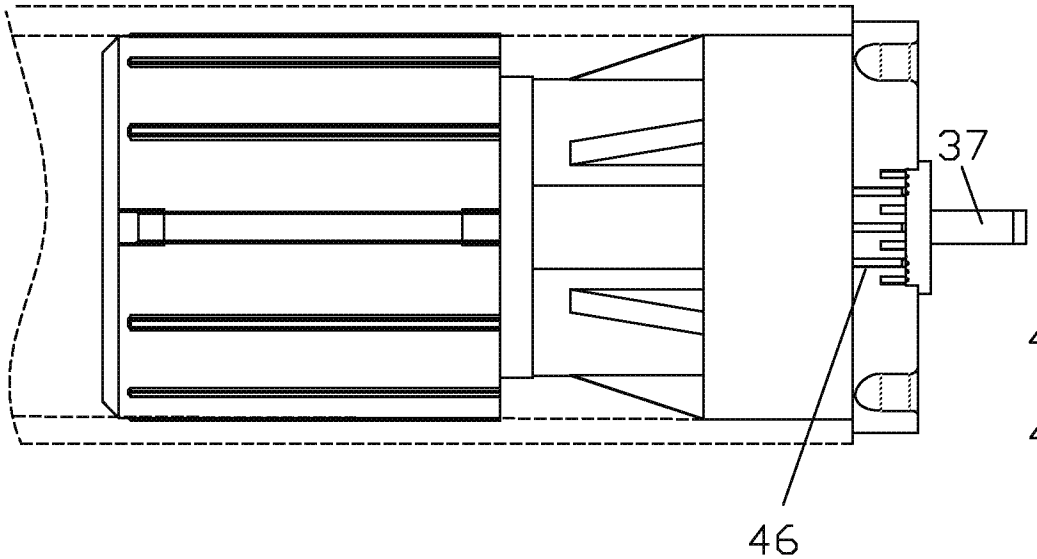
FIG. 14*a* is a side view of the drive coupling shown in FIG. 12 wherein the driven member is at a neutral position relative to the drive coupling body.

In FIGS. 9*a*, 9*b*, 10*a* and 10*b* there is shown a typical double-tube or dual roller blind wherein the blind is comprised of two roller tubes 2 that are driven by a single drive mechanism 25 at the end of one of the roller tubes. The roller tubes are mounted longitudinally end-to-end such that activation of drive mechanism 25 causes the two roller tubes to be rotated in unison. Drive mechanism 25 may be a standard clutch mechanism drive by a chain or chord, or alternatively, may be an electric motor driven. FIGS. 9*a* and 9*b* demonstrate a situation where the blind fabric 3 wound upon adjacent roller tubes is aligned such that the bottom bars 26 are horizontally aligned. FIGS. 10*a* and 10*b* demonstrate the situation where the adjacent bottom bars are misaligned horizontally.

In an embodiment of the invention, there is also provided a blind fabric alignment device 27 that can be utilized to address the misalignment on bottom bars on a multi-tube roller blind, and that permits an adjustment to aid in re-aligning misaligned bottom bars.

With specific reference to FIGS. 11*a* through 15*b*, there is shown a blind fabric alignment device comprised generally of a drive coupling body 28, a driven member 29, a torque transfer mechanism 30 and an adjuster 31. Drive coupling body 28 is configured to be releasably secured to an end of a roller tube of the roller blind to the extent that when secured to the roller tube rotation of the drive coupling body causes a corresponding rotation of the roller tube. A wide variety of different mechanisms could be employed to achieve such function. In the attached drawings, drive coupling body 28 is fitted with a number of longitudinally oriented spines 32 that engage corresponding splines or ribs on the inside of the roller tube so that when a first end 33 of the drive coupling body 28 is inserted into the hollow end of the roller tube, the two components will be rotationally locked together, with the second end 34 of drive coupling body 28 positioned exterior to the end of the roller tube.

As shown, driven member 29 is mounted to drive coupling body 28 and is designed to be securable to a source of rotational torque supplied by the adjacent roller tube. In the attached drawings, driven member 29 is a pin 35 rotationally received within drive coupling body 28. Outer end of pin 35 is in the form of a tongue 36 that may be received within a slot or yoke on the drive coupling 39 of an adjacent roller tube 40. Through the receipt of tongue 37 in slot 38, the two roller tubes will be locked together rotationally such that rotational torque will be transferred from drive mechanism 25, through adjacent roller tube 40, through drive coupling 39, through the engagement of tongue 37 within slot 38 and then ultimately through driven member 29 to drive coupling body 28.

In an aspect of the invention, torque transfer mechanism 30 is secured to pin 35 to act as a means for the transference of rotational force from pin 35 to drive coupling body 28. That is, rotation of pin 35 causes rotational torque to be transferred to drive coupling body 28 through torque transfer mechanism 30. In the particular embodiment shown in the attached drawings, torque transfer mechanism 30 comprises a radial flange 41 secured to pin 35. Flange 41 extends outwardly from the surface of pin 35 at a generally right angle to a longitudinal axis of the pin. Flange 41 may be secured to pin 35 through inserting one end of flange 41 into the pin body and securing it in place through use of an adhesive or a mechanical fastener, or by threading it in place. In other embodiments, flange 41 could be of uniform construction with pin 35. Other possible structures of flange 41 and pin 35 could also be used.

The invention further permits adjuster 31 to alter the rotational position of flange 41 (and hence pin 35) relative to drive coupling body 28. In the embodiment shown, adjuster 31 includes a pair of opposed posts 42 and 43, at least one of which flange 41 will engage when pin 35 is rotated. That is, when pin 35 is rotated in a first direction, one side of flange 41 engages one of posts 42 and 43 transferring rotational torque from flange 41 to the drive coupling body and causing the drive coupling body to rotate in the first direction. Similarly, when flange 41 is rotated in a second opposite direction, the other side of flange 41 transfers torque to the other posts 42 or 43 causing drive coupling body 28 to rotate in the opposite direction.

Figure 15B:
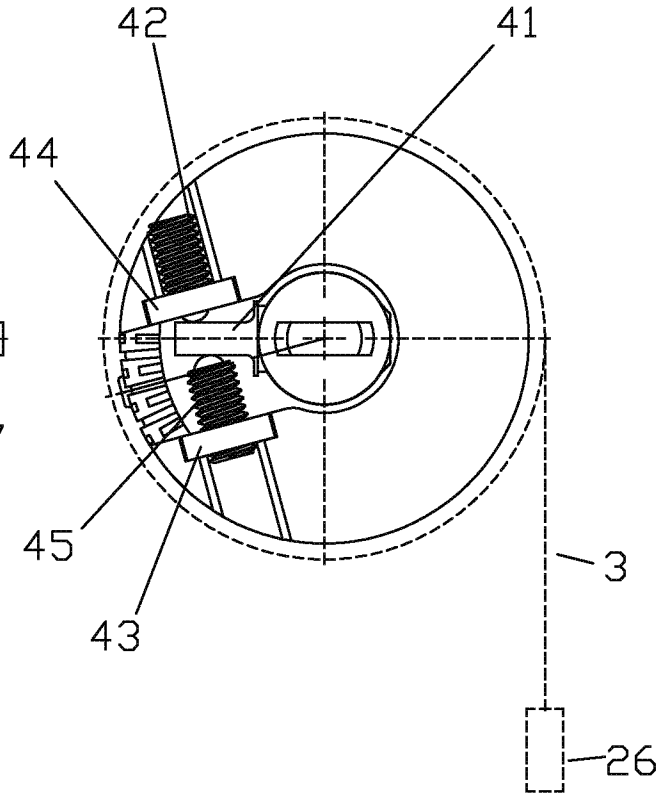
FIG. 15*b* is a right end view of the drive coupling shown in FIG. 15*a;*
Figure 15A:
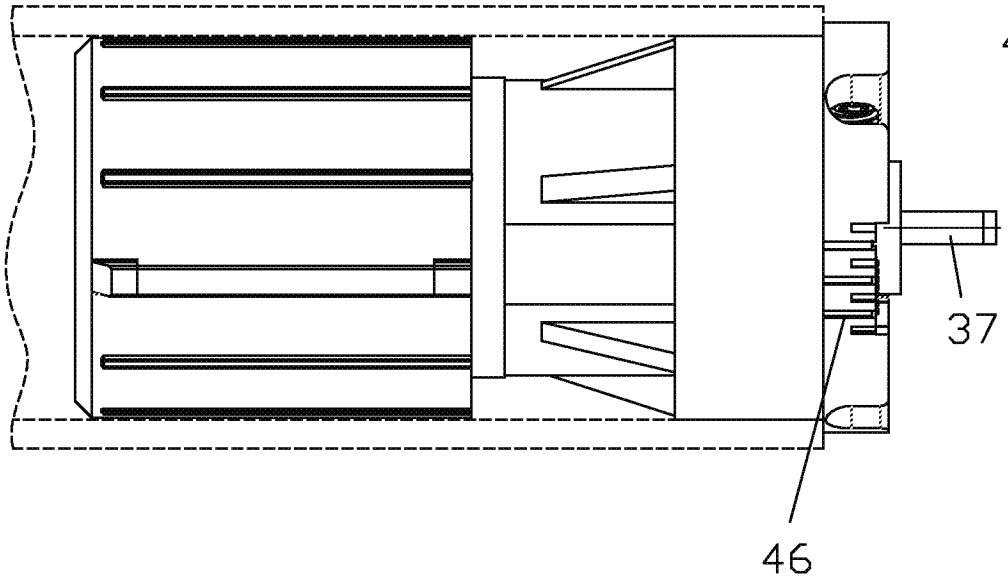
FIG. 15*a* is a side view of the drive coupling shown in FIG. 12 wherein the driven member has been rotationally offset from a neutral position relative to the drive coupling body.
Figure 16:
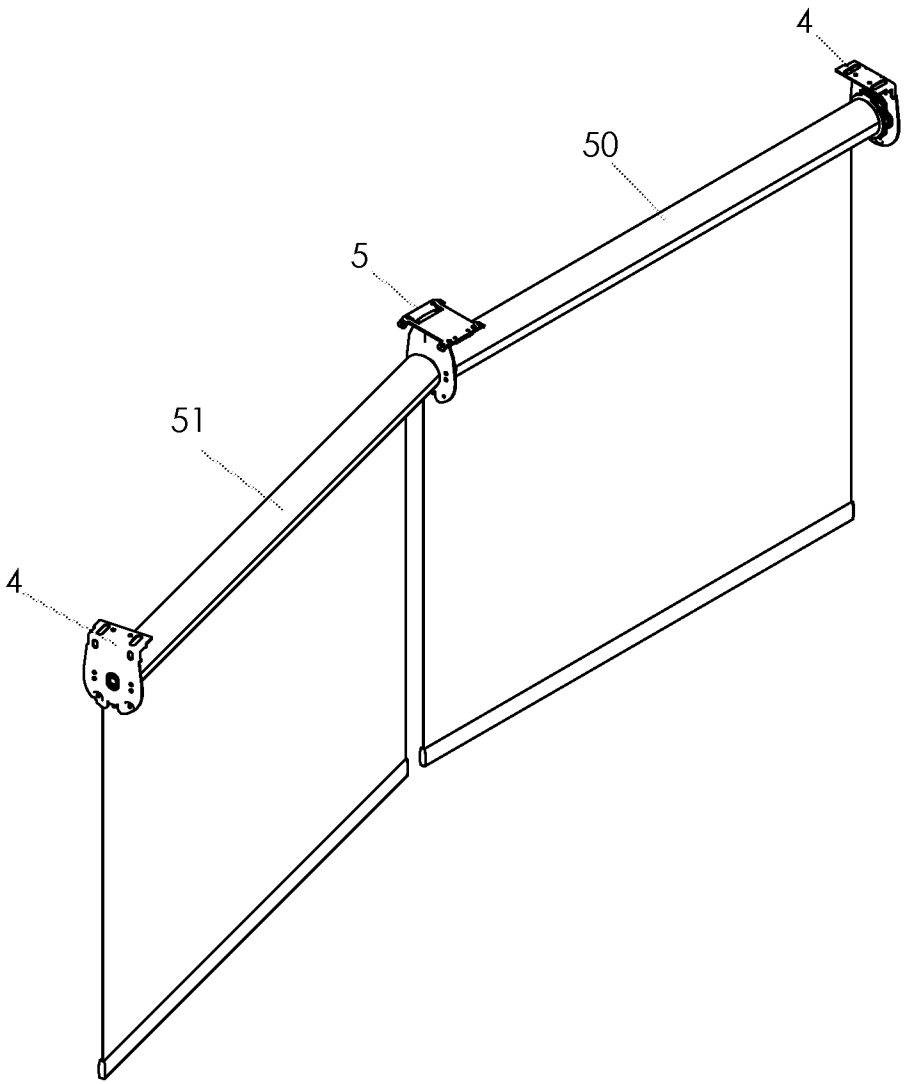
FIG. 16 is an upper side perspective view of a roller blind comprising two individual roller tubes mounted end-to-end where the roller tubes are at an angle, as would typically be the case when used in association with a bay window.
Figure 18:
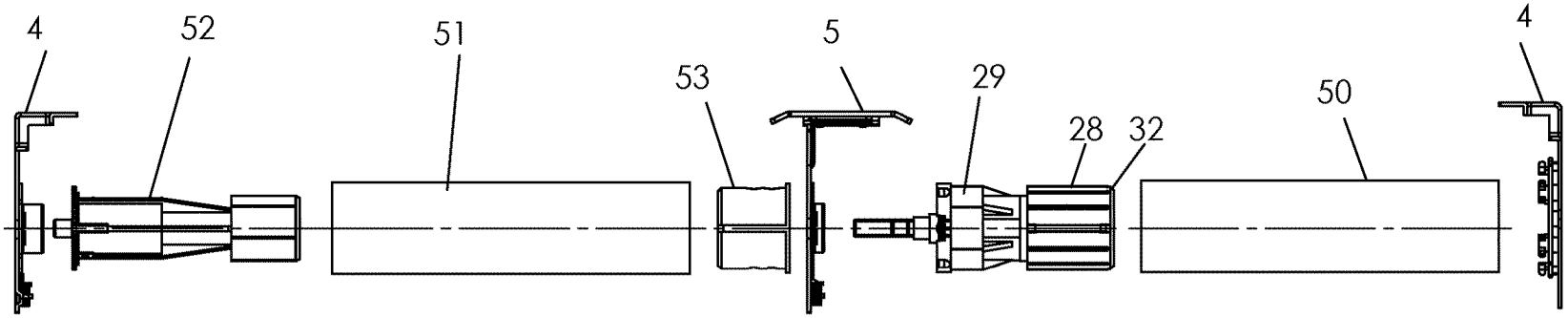
FIG. 18 is an exploded view of the roller blind shown in FIG. 17 with the blind fabric removed.
Figure 17:
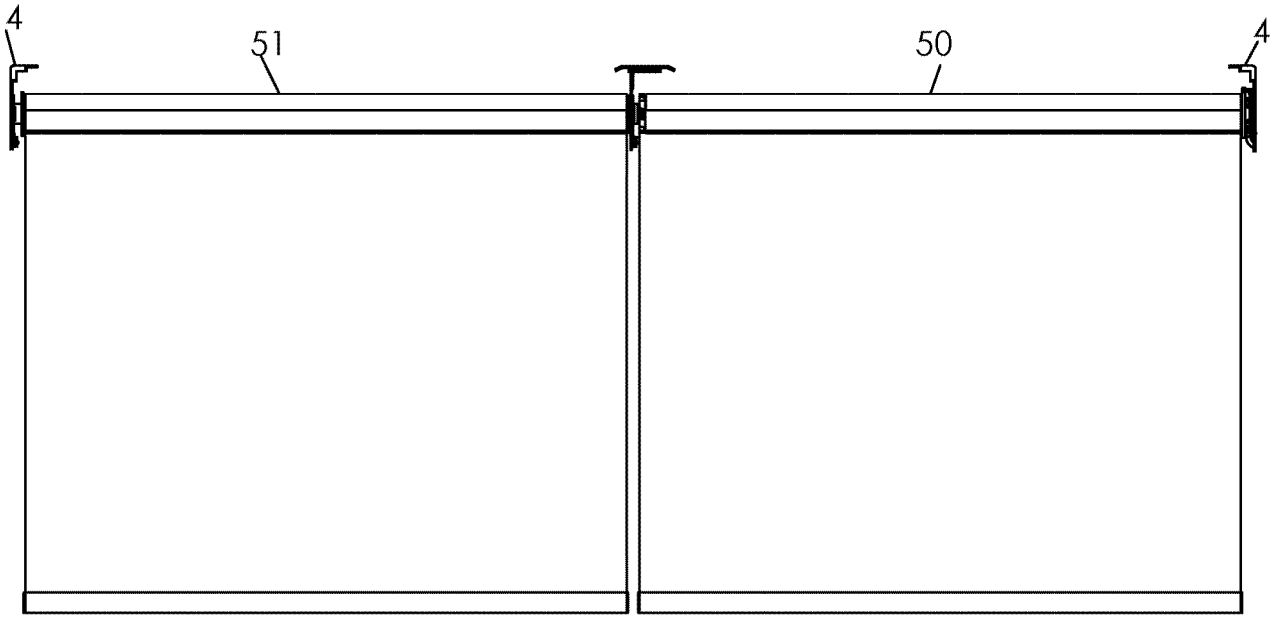
FIG. 17 is a front elevation view of the roller blind shown in FIG. 16.

Posts 42 and 43 may be adjustable with respect to their position relative to drive coupling body 28 to alter the rotational contact points between flange 41 and posts 42 and 43, and to thereby alter the rotational position of pin 35 relative to drive coupling body 28. Since pin 35 is effectively rotationally connected or otherwise secured to drive 39 of adjacent roller tube 40, it will be appreciated that by adjusting the contact points between flange 41 and posts 42 or 43 the rotational relationship between the two adjacent roller tubes can be altered. In the attached drawings, posts 42 and 43 are threadably received within shoulders 44 and 45 of drive coupling body 28 (see FIGS. 13-15). Threading posts 42 and 43 into or out of shoulders 44 and 45 will have the effect of altering the relative rotational position of the two adjacent roller blind tubes and the blind fabric received thereabout. For example, in the embodiment shown in FIGS. 14*a* and 14*b*, flange 41 is spaced approximately equal distance from each of shoulders 43 and 45, with posts 42 and 43 threaded an approximate equal distance into each of the shoulders. In this instance, flange 41 is in a "neutral" position between the two shoulders. If in order to horizontally align the bottom bars of the blind fabrics of the two roller tubes, it is desirous to rotate a portion of the blind fabric back onto the roller tube to lift bottom bar 26 (as shown in FIG. 15*b*) the uppermost of the posts can be threadably withdrawn from its respective shoulder with the lower most post threaded further into the shoulder to effectively cause a rotation of the roller blind tube and to place fabric back onto the roller tube, thereby raising the elevation of bottom boar 26. If desired, the relative rotation of the two posts 42 or 43 could be reversed to remove fabric from the roller tube and lower the elevation of bottom bar 26.

Drive coupling body 28 may include graduation indicators 46 providing a visual indication of the rotational position of flange 41 relative to drive coupling body 28. Further, it will be appreciated that in an alternate embodiment, posts 42 and 43 could be of different structures and different configurations and could be secured to drive coupling body 28 by means other than by threadably receiving the posts within shoulders 44 and 45.

It will thus be appreciated that through the employment of the above described invention, the alignment of the bottom bars of a multi-roller tube roller blind can be adjusted through merely adjusting one or both of posts 42 or 43.

With reference to FIGS. 16 through 21 there is shown an embodiment of a roller blind that is comprised generally of a first roller tube 50 and a second roller tube 51, wherein the two roller tubes are at an angle to one another, and not in a parallel configuration as in the more traditional roller blind structure. It will be appreciated that such angular configurations are useful, for example, in bay window applications. In this embodiment the outer ends of the roller tubes are mounted to a pair of end brackets 4, with the adjacent ends of the roller tubes mounted to a middle bracket 5. First roller tube 50 is mounted to middle bracket 5 by means of driven member 29 of drive coupling 28 that is received through middle bracket 5. The opposite end of roller tube 50 may be mounted to an end bracket 4 by a drive mechanism, which may be a chain and clutch drive or an electric motor. Second roller tube 50 has its outer end secured to end bracket 4 by means of idle end 52 and its inner end secured to driven member 29 of drive coupling 28 by means of an angular roller tube end coupling 53.

Figure 20:
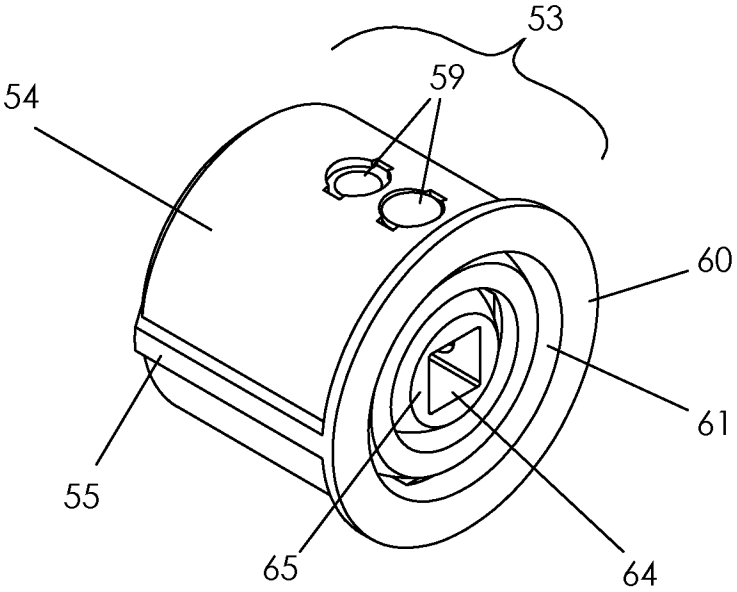
FIG. 20 is an upper end perspective view of the angular roller tube end coupling for the angularly oriented roller tube.
Figure 21:
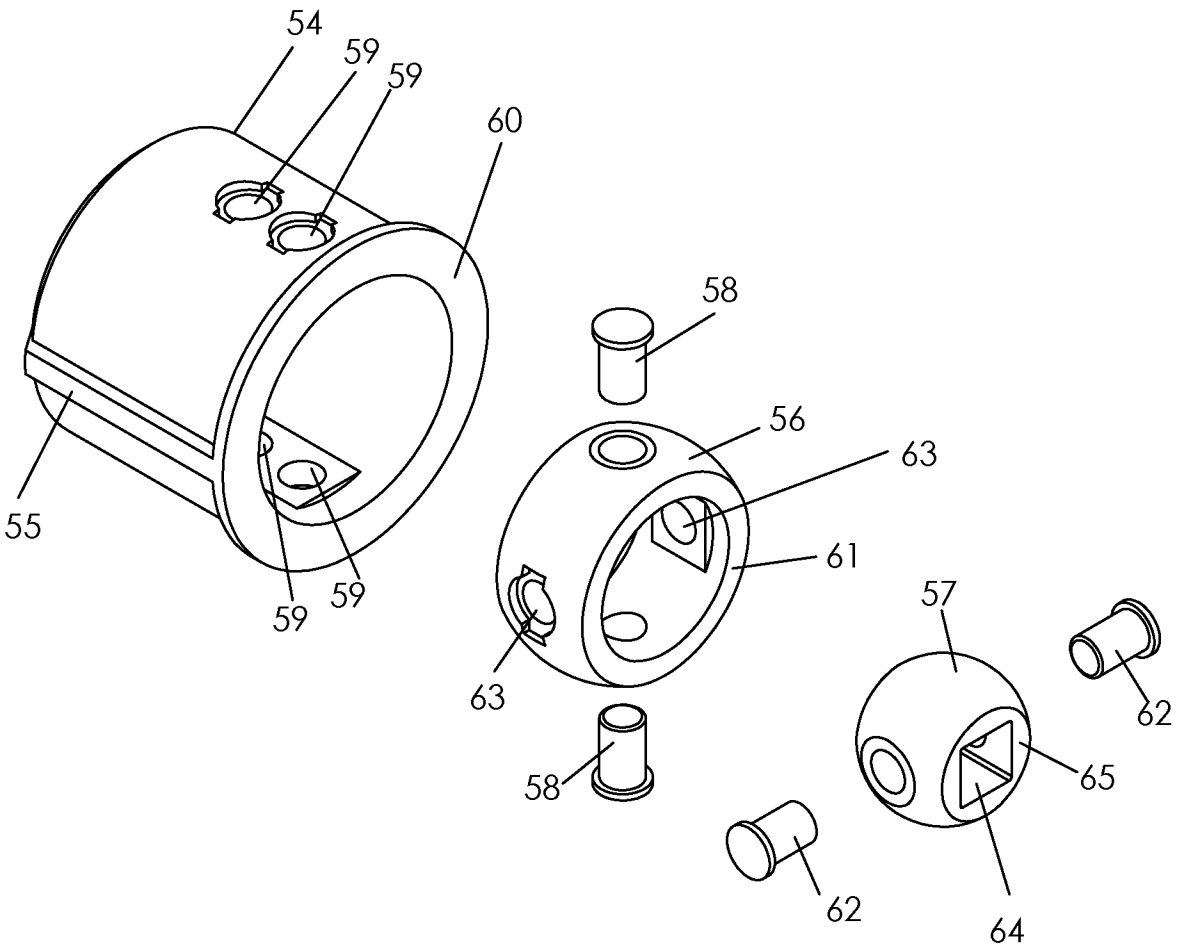
FIG. 21 is an exploded view of the angular roller tube end coupling shown in FIG. 20.

With specific reference to FIGS. 20 and 21, there is shown in detail the structure of angular roller tube end coupling 53. End coupling 53 includes a generally cylindrical hollow body 54 that is received within the end of second roller tube 51. The exterior of body 53 may be fitted with one or more ribs or ridges 55 that may mate with longitudinally oriented ribs or channels on the inside diameter of roller tube 51 to effectively lock end coupling 53 to the roller tube such that rotation of end coupling 53 causes a corresponding rotation of second roller tube 51.

Positioned within the hollow interior of cylindrical body 54 is a nested pair of gimballed sleeves, 56 and 57 respectively. In the attached drawings sleeve 56 is of a larger diameter and has an axis of rotation defined by a pair of pins 58 that are received through openings 59 within cylindrical body 54 in order to secure sleeve 56 within the hollow interior of the cylindrical body. Alternately, a single pin 58 could be used. The exterior surface of sleeve 56 may have a concave curvature to allow the sleeve a greater range of rotational movement when received within cylindrical body 54 than would be the case if a sleeve were in the shape of a right cylinder. It will be appreciated from a review of FIGS. 20 and 21 that by equipping cylindrical body 54 with a plurality of openings 59, the degree to which sleeve 56 can be received within the hollow interior of cylindrical body 54 can be adjusted. That is, by mounting pins 58 through openings 59 further away from the front face 60 of cylindrical body 54, sleeve 56 can be positioned such that when rotated about pins 58 its outer surface 61 remains generally close to the plane of front surface 60.

As shown in FIGS. 20 and 21, gimballed sleeve 57 is received within the hollow interior of gimballed sleeve 56. Further, sleeve 57 is retained within sleeve 56 through the use of a pair of pins 62 that are received through holes or openings 63 in sleeve 56. Alternately, a single pin 62 could be used. In the attached drawings, gimballed sleeve 57 is ball or sphere-like in shape, however, it will be appreciated that in other embodiments it could have an overall shape or curved exterior surface somewhat similar to sleeve 56.

From an understanding of the invention and an examination of FIGS. 21 and 22, it will be understood that the axis of rotation of sleeves 56 and 57 as defined by pins 58 and 62 are orthogonal. Further, gimballed sleeve 57 is fitted with a bore 64 that is of a shape complementary to that of driven member 29 such that the driven member may be received within bore 64 causing sleeve 57 to rotate with rotation of the driven member. It will be further appreciated that the mounting of sleeve 57 within sleeve 56 and the mounting of sleeve 56 within cylindrical body 54 will thus result in a rotation of second roller tube 51 upon the rotation of driven member 29. Accordingly, it will be further understood that as a result of the described structure, first and second roller tubes 50 and 51 will rotate in unison.

Figure 19:
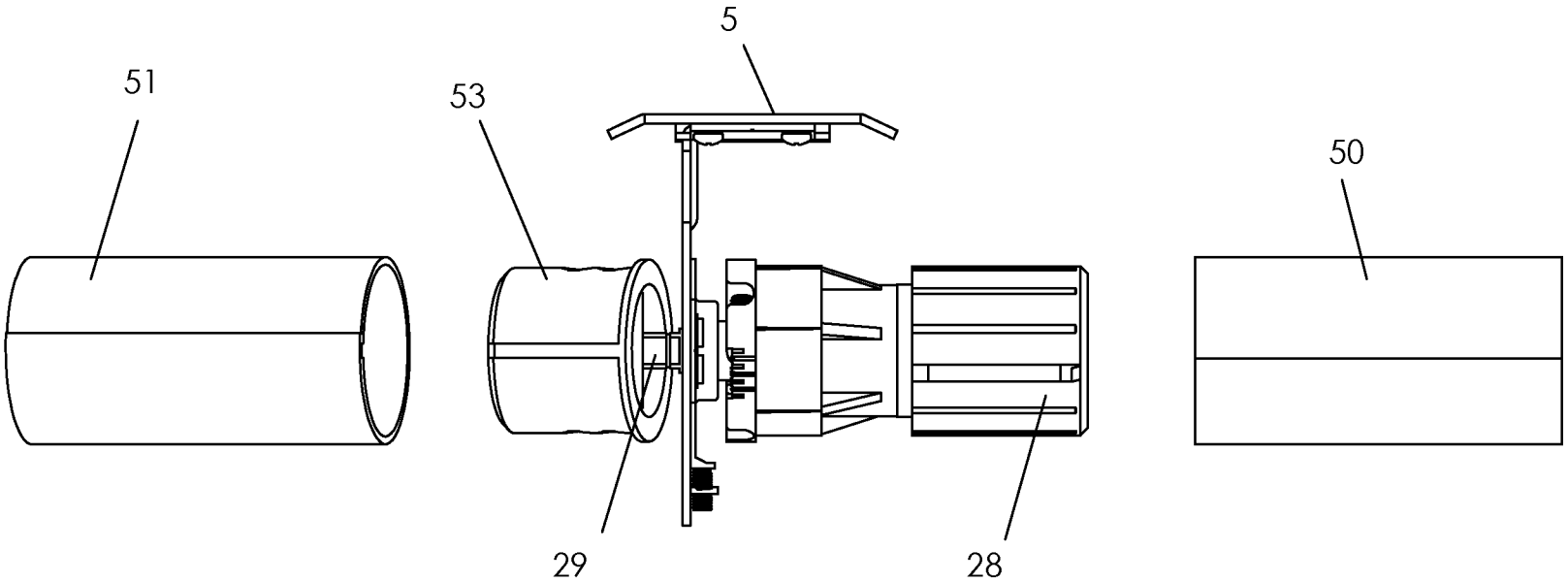
FIG. 19 is a partially exploded view similar to FIG. 18 showing the angular orientation of the two roller tubes.

The above described structure of angular roller tube end coupling 53 presents a means for connecting second roller tube 51 with first roller tube 50 so that the two roller tubes can be rotated together in unison. Further, end coupling 53 also presents the ability for the two roller tubes to be offset in a horizontal and/or vertical plane, if desired. The nesting of gimballed sleeves 56 and 57 within the hollow interior of cylindrical body 54, in conjunction with the orthogonal relationships of pins 58 and 62 upon which sleeves 56 and 57 rotate, permits a horizontal and/or offset of second roller tube 51 relative to first roller tube 50, while still allowing rotational torque from first roller tube 50 to be transmitted to second roller tube 51. Such is the situation shown in FIG. 16 where the depicted blind is for use in a bay window application. FIG. 19 also demonstrates an offset of second roller tube 51 relative to first roller tube 50 and the receipt of driven member 29 within bore 64 to permit rotational energy to be transmitted from first roller tube 50 to second roller tube 51. The formation of gimballed sleeve 57 with a ball or generally spherical shaped exterior surface permits an enhanced angular offset of second roller tube 51 without outer surface 65 of gimballed sleeve 57 coming into contact with the interior surface of sleeve 56, as could occur if sleeve 57 had a shape more closely resembling a right cylinder.

It will thus be appreciated that the embodiment shown in FIGS. 16 through 21 allows for flexibility in terms of the angular offset between second roller tube 51 relative to first roller tube 50, while still ensuring a secure connection between the roller tubes so that a drive mechanism operatively associated with first roller tube 50 results in second roller tube 51 being simultaneously driven.

It is to be understood that what has been described are the preferred embodiments of the invention. The scope of the claims should not be limited by the preferred embodiments set forth above, but should be given the broadest interpretation consistent with the description as a whole.

What is claimed is:

1. A blind fabric alignment device for a roller tube of a multi-tube roller blind, the alignment device comprising:

a drive coupling body securable to an end of the roller tube of the roller blind, when secured to the roller tube rotation of said drive coupling body causing an associated rotation of the roller tube;

a pin rotationally received within said drive coupling body, said pin securable to a source of transfer rotational torque;

a radial flange secured to said pin such that rotation of said pin causes rotational torque to be transferred to said drive coupling body through said pin; and an adjuster positioned on said drive coupling body, said radial flange transferring rotational torque from said pin to said drive coupling body through said adjuster, said adjuster permitting an alteration of a rotational position of said pin relative to said drive coupling body, said adjuster comprising a pair of opposed posts, when said pin is mounted to said drive coupling body said radial flange is received between said pair of opposed posts such that rotation of said pin in a first direction causes said radial flange to bear against one of said pair of opposed posts and to thereby rotate said drive coupling body in said first direction, and wherein rotation of said pin in an opposite direction causes said radial flange to bear against the other of said pair of opposed posts thereby causing said drive coupling body to rotate in said opposite direction.

2. The adjustment device as claimed in claim 1 wherein the position of said pair of opposed posts relative to said drive coupling body can be altered to allow the rotational position of said pin relative to said drive coupling body to be altered.

3. The adjustment device as claimed in claim 2 wherein said pair of opposed posts are threadably received within said drive coupling body such that rotation of said pair of opposed posts alters their position relative to said drive coupling body and thereby alters a contact between said radial flange and said pair of opposed posts and the rotational position of said pin with respect to said drive coupling body.

4. The adjustment device as claimed in claim 3 wherein said pin is rotationally securable to a drive coupling of an adjacent roller tube in the multi-tube roller blind so that rotation of the adjacent roller tube causes an associated rotation of said pin, wherein adjustment of said pair of opposed posts within said drive coupling body causes an alteration of the rotational position of said drive coupling body, and the roller tube secured thereto, relative to the drive coupling and the adjacent roller tube.

5. The alignment device as claimed in claim 4 wherein said drive coupling body includes graduation indicators providing a visual indication of the rotational position of said pin relative to said drive coupling body.

6. The adjustment device as claimed in claim 2 wherein said pair of opposed posts are screws or bolts threadably received within said drive coupling body, said radial flange engaging one of said pair of opposed posts upon rotational torque applied to said pin, wherein threading one or both of said screws or bolts into or out of said drive coupling body permits an adjustment of the rotational position of said drive coupling body relative to said pin and an alteration of an elevation of a lower end of blind fabric received about an associated roller tube.

7. A blind fabric alignment device for a roller tube of a multi-tube roller blind, the alignment device comprising:

a drive coupling body securable to an end of the roller tube of the roller blind, when secured to the roller tube rotation of said drive coupling body causing an associated rotation of the roller tube;

a pin rotationally received within said drive coupling body and having an end securable to a source of rotational torque, said pin having a longitudinal axis generally aligned with the longitudinal axis of said drive coupling body, said pin including a radially oriented flange; and a pair of opposed posts threadably secured to said drive coupling body, wherein rotational torque applied to said pin in a first direction causes an engagement of said flange with one of said pair of opposed posts causing said drive coupling body to rotate in a first direction, and wherein rotation of said pin in an opposite direction causes said flange to bear against the opposite of said pair of opposed posts causing said drive coupling body to rotate in said opposite direction, whereby altering the position of said pair of opposed posts relative to said drive coupling body alters a rotational point of contact between said flange and said pair of opposed posts and a rotational position of said pin with respect to said drive coupling body and the roller tube secured thereto.

8. The alignment device as claimed in claim 7 wherein said drive coupling body includes graduation indicators providing a visual indication of the rotational position of said pin relative to said drive coupling body.

* * * * *